United States Patent [19]

Behrens

[11] Patent Number: 4,633,930

[45] Date of Patent: Jan. 6, 1987

[54] MOLTEN METAL SHOT SIZE AND DELIVERY MECHANISM FOR CONTINUOUS CASTING OPERATIONS

[75] Inventor: Hugh C. Behrens, Angleton, Tex.

[73] Assignee: The Dow Chemical Company, Midland, Mich.

[21] Appl. No.: 743,343

[22] Filed: Jun. 11, 1985

[51] Int. Cl.[4] ..... B22D 17/10; B22D 23/00

[52] U.S. Cl. ..... 164/66.1; 164/259; 164/312; 164/113; 222/596; 222/603

[58] Field of Search ..... 164/66.1, 259, 312, 164/113, 61, 253, 313; 222/596, 603

[56] References Cited

U.S. PATENT DOCUMENTS 3,999,593 12/1976 Kaiser ..... 164/113 X

FOREIGN PATENT DOCUMENTS 45-32834 10/1970 Japan ..... 164/113

57-97860 6/1982 Japan ..... 164/66.1

*Primary Examiner*—Kuang Y. Lin

*Attorney, Agent, or Firm*—Glwynn R. Baker

[57] ABSTRACT

There is described a device and process for delivering a predetermined quantity of molten metal to a metal casting operation via metal transfer members, such as thermally heated pipes under a positive head to the shot size and delivery system wherein the device has a metal receiving chamber, a hydraulic ram for metal movement and an inert gas sweep capability. The ram chambers has only a nominal relationship to the volume of metal to be used to fill the mold, the true measurement of the volume being a factor of the pressure of the molten metal being delivered to the chamber and the time the molten metal is allowed to flow into the chamber before the ram is activated to force the metal under a definite predetermined pressure into the mold cavity. It is of course to be understood that the molten metal being delivered to the chamber under pressure flows into the mold cavity during the "loading" or "charging" step since there is no resistance to the free flow of the metal until the ram starts it movement and closes off the molten metal inlet. Associated with the chamber is an inert gas source which is introduced through the inert gas inlet positioned such that the gas will flow into the chamber and hence into the mold cavity during the period prior to the introduction of molten metal into the chamber and the mold cavity and throughout the period prior to the ram closing off the molten metal inlet and pressurizing the chamber and the mold cavity to force the metal into the cavity under sufficient pressure to insure the smallest detail of the die is adequately filled with the metal.

2 Claims, 1 Drawing Figure

SHOT SIZE AND DELIVERY APPARATUS

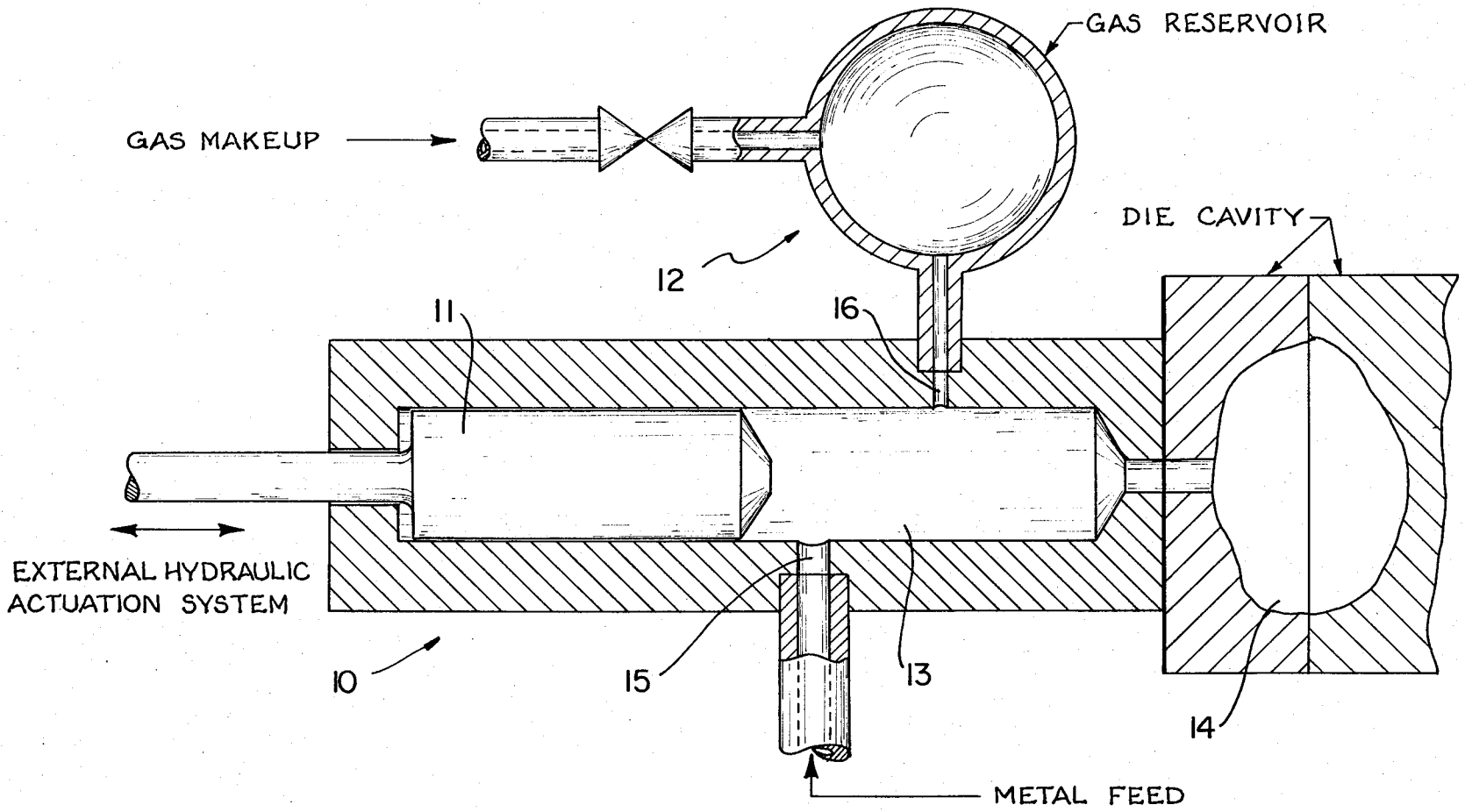
SHOT SIZE AND DELIVERY APPARATUS

MOLTEN METAL SHOT SIZE AND DELIVERY MECHANISM FOR CONTINUOUS CASTING OPERATIONS

CROSS REFERENCE TO RELATED APPLICATIONS

The invention described herein is related to my copending U.S. application Ser. No. 720,434, filed Apr. 5, 1985, entitled "Annular Linear Induction Pump with an Externally Supported Duct"; Ser. No. 741,782, filed June 6, 1985, entitled "Molten Metal Handling System"; Ser. No. 741,939, filed June 6, 1985, entitled "Flat Linear Flowmeter"; Ser. No. 743,442, filed June 11, 1985, entitled "Annular Linear Induction Flowmeter".

BACKGROUND OF THE INVENTION

In modern day casting machines, it is essential that the molten metal be delivered in amounts and under pressures such that the die or mold will be filled but not over filled. However, in most casting operations the plants still use ladles as means to transport the molten metal to the ram chamber of existing shot mechanisms of present day die casting or stripcasting machines and, thus, production is in the nature of a batch or semi-batch operation to the die casting machine. In addition when the metal is magnesium such systems have difficulty excluding ambient atmosphere from coming into contact with the metal which creates a safety hazard as well as contaminating the metal with the oxides of the molten metal.

It would therefore be advantageous to have a system where the metal was delivered from a remote location in pipes to the shot mechanism and have a shot mechanism which can through pressure-time relationship deliver definite quantities of metal to the die as well as exclude the metal from contact with the ambient atmosphere and include an inert gas or mixture or air to which $CO_2$ and between 0.1 and 1% sulfur hexafluoride sweep to the ram chamber and the mold to further prevent the metal from coming into contact with the ambient atmosphere or provide a protective film at the metal gas interface to prevent or reduce oxidation of the metal which flows into the mold when the mold is opened to eject the molded article.

BRIEF DESCRIPTION OF THE INVENTION

In accordance with the present invention molten metal is brought to the casting operation via metal transfer members, such as thermally heated pipes under regulated positive head pressure to a shot size and delivery system having a hydraulic ram for metal movement and an inert gas sweep capability. The ram chamber has only a nominal relationship to the volume of metal to be used to fill the mold, the true measurement of the volume being a factor of the pressure of the molten metal being delivered to the chamber and the time the molten metal is allowed to flow into the chamber before the ram is activated to force the metal under a definite predetermined pressure into the mold cavity. It is of course to be understood that the molten metal being delivered to the chamber under pressure flows into the mold cavity during the "loading" or "charging" step since there is no resistance to the free flow of the metal until the ram starts its movement and closes off the molten metal inlet. Associated with the chamber is an inert gas source which is introduced through the inert gas inlet positioned such that the gas will flow into the chamber and hence into the mold cavity during the period prior to the introduction of molten metal into the chamber and the mold cavity and throughout the period prior to the ram closing off the molten metal inlet and pressurizing the chamber and the mold cavity to force the metal into the cavity under sufficient pressure to insure the smallest detail of the die is adequately filled with the metal.

In operation of the device of the present invention a hydraulic ram is programmed to be retracted allowing delivery of molten metal under a positive head such as preferably developed by a molten metal pump for a period of time to fill the mold cavity and the ram chamber with sufficient metal when forced into the cavity under the ram pressure, to fill the cavity, but not overfill. Upon the time period having elapsed the hydraulic ram is actuated and moves forward forcing the metal into the mold and closing off the molten metal inlet thus causing the ram to pressurize a measured quantity of metal in the mold cavity. When the ram is in its full forward position, and, following a determinable time period for solidification of at least the surface of the metal at the mold interface, the mold is opened and the article ejected. The mold is then closed and the ram retracted to repeat the sequence. Since ambient air will fill the mold after ejection of the article, it is often necessary, and when casting magnesium essential from the safety standpoint, to flush the mold with an inert gas to remove any oxygen from the cavity before the molten metal is introduced into the mold. Thus, in accordance with the present invention, a source of inert gas is provided to the ram chamber, the inlet of which is located along the ram travel at a point where the gas will be released into the chamber and thus into the mold cavity during the travel of the ram into its most retracted position. Since almost all molds have vents the inert gas if pressurized above the ambient atmosphere pressure will fill the cavity and force the air which was entrapped in the mold cavity on closing to be vented from the cavity as it is filled with the inert atmosphere. The inert gas inlet having been positioned to begin the flushing operation prior to the ram being fully retracted and also prior to the introduction of metal into the chamber will effectively protect the incoming metal from contacting any ambient atmosphere during the casting operation. Of course, since the inlet for the inert gas is not closed off until the molten metal inlet is closed off, the operation provides a positive flow of inert gas which will blanket the surface of the molten metal in the mold cavity during the filling and final ramming of the metal into the mold.

BRIEF DESCRIPTION OF THE DRAWING

The sole FIGURE shows the arrangement of the shot size and delivery apparatus in according to the invention.

DETAILED DESCRIPTION OF THE INVENTION

With particular reference to the drawing and in accordance with the present invention molten metal is brought to the casting operation via metal transfer members, such as thermally heated pipes to a shot size and delivery system 10 having a hydraulic ram 11 for metal movement and an inert gas sweep capability 12. The ram chamber 13 has only a nominal relationship to the volume of metal to be used to fill the mold, the true measurement of the volume being a factor of the pressure of the molten metal being delivered to the chamber and the time the molten metal is allowed to flow into the chamber before the ram is activated to force the metal under a definite predetermined pressure into the mold cavity of die casting machine 14. It is of course to be understood that the molten metal being delivered to the chamber 13 under pressure flows into the mold cavity of mold 14 during the "loading" or "charging" step since there is no resistance to the free flow of the metal until the ram 11 starts it movement and closes off the molten metal inlet 15. Associated with the chamber 13 is an inert gas source, not shown, which is introduced through the inert gas inlet 16 positioned such that the gas will flow into the chamber 13 and hence into the mold cavity die casting machine 14 during the period prior to the introduction of molten metal into the chamber 13 and the mold cavity and throughout the period prior to the ram closing off the molten metal inlet 15 and pressurizing the chamber and the mold cavity to force the metal into the cavity under sufficient pressure to insure the smallest detail of the die is adequately filled with the metal.

In operation of the device of the present invention the hydraulic rim 11 is programmed to be retracted allowing delivery of molten metal under a positive head such as preferably developed by a molten metal pump for a period of time to fill the mold cavity and the ram chamber with sufficient metal, when forced into the cavity under the ram pressure, to fill the cavity, but not overfill. Upon the time period having elapsed the hydraulic ram 11 is actuated and moves forward forcing the metal into the mold and closing off the molten metal inlet 12 thus causing the ram 11 to pressurize a measured quantity of metal in the mold cavity. When the ram 11 is in its full forward position and following a determinable time period to allow for solidification of at least the surface of the metal at the mold interface, the mold is opened and the article ejected. The mold is then closed and the ram 11 retracted to repeat the sequence. Since ambient air will fill the mold after ejection of the article, it is often necessary, and when casting magnesium essential from the safety standpoint, to flush the mold with an inert gas or mixture of gases, such as air containing a considerable quantity, nominally about 50%, of $CO_2$ and from about 0.01 to about 1.0 percent of sulfur hexafluoride (commonly used to blanket the surface of magnesium to prevent further oxidation of the surface or at least reduce the rate of oxidation at the surface) to remove any oxygen from the cavity before the molten metal is introduced into the mold or blanket the surface of the magnesium in the chamber and the mold during the mold filling operation. Thus, in accordance with the present invention, a source of inert gas is provided to the ram chamber 13, the inlet 16 of which is located along the ram travel at a point where the gas will be released into the chamber and thus into the mold cavity during the travel of the ram into its most retracted position. Since almost all molds have vents the inert gas if pressurized above the ambient atmosphere pressure will fill the cavity and force the air which was entrapped in the mold cavity on closing to be vented from the cavity as it is filled with the inert atmosphere. The inert gas inlet having been positioned to begin the flushing operation prior to the ram being fully retracted and also prior to the introduction of metal into the chamber will effectively protect the incoming metal from contacting any ambient atmosphere during the casting operation. Of course, since the inlet for the inert gas is not closed off until the molten metal inlet is closed off, the operation provides a positive flow of inert gas which will blanket the surface of the molten metal in the mold cavity during the filling and final ramming of the metal into the mold.

What is claimed is:

1. A shot size and delivery device comprised of a body having a chamber, a retractable ram within said chamber, a metal inlet in the lower side of said chamber at a position in the length of said chamber near the retracted position of said ram, a gas inlet in the upper side of said chamber positioned forward of said metal inlet relative to said retracted ram position, a source of molten metal under a positive pressure associated with said metal inlet, a source of inert non-reactive gas associated with said gas inlet, and a source of power to move said ram.

2. A method for delivering a measured quantity of molten metal to a casting machine which comprises providing a source of molten metal under a positive head pressure to the inlet of a shot size and delivery device as set forth in claim 1, providing a source of inert gas or mixture of gases of reduced oxidizing potential containing a metal protective gas to the gas inlet of said device, said device associated with a casting machine having mold or die(s) to receive the molten metal, programming the movement of the ram of said device to move into the closed position when the amount of molten metal delivered to the device is sufficient to fill the mold or die cavity, and supplying the inert gas to the device under sufficient pressure to sweep the chamber and the mold or die of oxidizing ambient atmosphere, closing by movement of the ram past the metal inlet and subsequently past the gas inlet, both the metal inlet and the gas inlet being positioned along said chamber such that the ram will seal off said inlets prior to its full length of travel and continuing the movement of the ram until the mold cavity is under sufficient pressure to insure the die has been completely filled, said gas being admitted to the chamber and the mold or die during the retraction of the ram and throughout the metal filling step.

* * * * *